US006604557B2

(12) United States Patent
Awad

(10) Patent No.: US 6,604,557 B2
(45) Date of Patent: Aug. 12, 2003

(54) AUTOMOTIVE RADIATOR FLUSH SYSTEM AND METHODS OF USE

(76) Inventor: Adam Awad, 1360 Logan Ave., #100, Costa Mesa, CA (US) 92626

( * ) Notice: Subject to any disclaimer, the term of this patent is extended or adjusted under 35 U.S.C. 154(b) by 0 days.

(21) Appl. No.: 10/254,141

(22) Filed: Sep. 24, 2002

(65) Prior Publication Data

US 2003/0102049 A1 Jun. 5, 2003

Related U.S. Application Data

(63) Continuation-in-part of application No. 10/006,345, filed on Dec. 3, 2001, now Pat. No. 6,523,580.

(51) Int. Cl.[7] ..... B65B 1/04
(52) U.S. Cl. ..... 141/65; 141/59; 184/1.5
(58) Field of Search ..... 141/65, 67, 59, 141/301, 302, 98, 94, 95, 192, 198; 184/1.5

(56) References Cited

U.S. PATENT DOCUMENTS 5,103,878 A 4/1992 Cassia
5,615,716 A 4/1997 Akazawa
5,649,574 A 7/1997 Turcotte et al.
5,845,684 A 12/1998 Fletcher, Jr. et al.
6,234,215 B1 5/2001 Klamm

FOREIGN PATENT DOCUMENTS

EP 1013908 A1 6/2000

*Primary Examiner*—Steven O. Douglas
(74) *Attorney, Agent, or Firm*—Gene Scott-Patent Law & Venture Group

(57) ABSTRACT

A method of replacing radiator fluid in an automotive radiator includes providing two gas tight containers, a fluid conducting hose with a gas tight nozzle fitted into a radiator fill pipe nipple. The method further includes the steps of filling one of the containers with a fresh radiator fluid, drawing a high vacuum on a second one of the containers, drawing spent radiator fluid into the second one of the containers using only suction from the container, thereby leaving the automotive radiator under a partial vacuum and then drawing the fresh radiator fluid, from the first one of the containers, into the radiator using only suction from the partial vacuum in the radiator. A radiator flush step may also be applied following the same method, using two additional containers, one with initial high vacuum and the other containing flush fluid.

6 Claims, 11 Drawing Sheets

AUTOMOTIVE RADIATOR FLUSH SYSTEM AND METHODS OF USE

RELATED APPLICATIONS

This is a continuation-in-part application of a prior filed application having Ser. No. 10/006,345, now U.S. Pat. No. 6,523,580, and file date of Dec. 3, 2001.

INCORPORATION BY REFERENCE.

Applicant(s) hereby incorporate herein by reference, any and all U. S. patents, U.S. patent applications, and other documents and printed matter cited or referred to in this application.

BACKGROUND OF THE INVENTION

1. Field of the Invention

This invention relates generally to automotive radiator flush systems and their methods of use and more particularly to an automated or manually operated such system and its methods and especially to such a system with controls for switching to various modes of operation.

2. Description of Related Art

The following art defines the present state of this field:

Cassia, U.S. Pat. No. 5,103,878 describes a flush cap for a vehicle cooling system wherein the flush cap has an inlet through which fresh water enters and an outlet through which dirty coolant leaves. The method employs the flush cap to flush the cooling system of the vehicle. The radiator cap can be adapted to drain a radiator using a hose attached to the outlet of the cap.

Akazawa, U.S. Pat. No. 5,615,716 describes an engine coolant changing apparatus for changing an engine coolant such as LLC (long-life coolant) in an engine coolant path containing a radiator, comprising coolant storing means possessing a pressure action port and a liquid inlet and outlet, detaching mechanism to be attached or detached to or from a filler port of a radiator, communicating device for communicating between the liquid inlet and outlet and the detaching device, and pressure action device for applying a negative pressure to the pressure action port to overheat the coolant to a low temperature by driving an engine when discharging the coolant from an engine coolant system, and applying a positive pressure to the pressure action port when feeding a fresh liquid, so that the coolant can be changed promptly in a short time, without requiring manipulation of radiator drain cock or jack-up of the vehicle.

Turcotte et al., U.S. Pat. No. 5,649,574 describes a removal and refill apparatus for use in removing and/or refilling coolant in an automotive cooling system. The automotive cooling system typically includes a radiator, overflow bottle, engine, water pump, and heater core elements. A method for utilizing the coolant removal and refill apparatus utilizing vacuum and pressure is described for use with the removal and refill apparatus.

Fletcher, Jr. et al., U.S. Pat. No. 5,845,684 describes a clean and easy-to-use, portable upright apparatus, and a method for its use, which can be used to flush and fill the radiator and coolant systems of motorized vehicles in approximately 15 minutes, the apparatus comprising a self-priming pump, a waste collection tank, a tank for holding new or recycled coolant, a filter assembly, and a wheeled support structure for conveniently and efficiently housing the pump, tanks, filter assembly, and the several hoses needed to perform the flush and fill procedure. Applications may include, but are not limited to, flushing coolant from automobile radiators and refilling them with new or recycled coolant.

Klamm, U.S. Pat. No. 6,345,215 describes an apparatus for adding coolant to a cooling system of a motor vehicle including a cap with a resilient sleeve that expands against the inside wall of a radiator filler neck to provide an air-tight connection. A valve attached to the cap controls the flow of air and coolant through the cap. A gauge on the cap indicates the pressure inside the radiator. A venturi assembly connected to the valve provides a source of vacuum for evacuating air from the cooling system. Thereafter, coolant is drawn through the cap by the vacuum created in the system.

Gayet, EP 1013908 describes a coolant fluid replacement device for an automobile, utilizing an open loop distribution circuit within the coolant loop during the replacement of the used coolant. The coolant loop comprises a radiator that includes an inlet from the engine and an outlet to the engine. During the coolant replacement process, the device is connected between the coolant pumps of the vehicle system. The new fluid is stored in a first reservoir. As the new fluid is pumped into the system, the old fluid is forced out into a second reservoir.

The prior art teaches the use of carts for providing automotive maintenance and especially in the field of radiator cleaning and refilling, but does not teach a combination cart with storage containers and a control panel all in wheeled portable configuration for easy selection of the maintenance steps to be taken. The present invention fulfills these needs and provides further related advantages as described in the following summary.

SUMMARY OF THE INVENTION

The present invention teaches certain benefits in construction and use which give rise to the objectives described below.

A method of replacing radiator fluid in an automotive radiator includes providing two gas tight containers, a fluid conducting hose with a gas tight nozzle fitted into a radiator fill pipe nipple. The method further includes the steps of filling one of the containers with a fresh radiator fluid, drawing a high vacuum on a second one of the containers, drawing spent radiator fluid into the second one of the containers using only suction from the container, thereby leaving the automotive radiator under a partial vacuum and then drawing the fresh radiator fluid, from the first one of the containers, into the radiator using only suction from the partial vacuum in the radiator. A radiator flush step may also be applied following the same method, using two additional containers, one with initial high vacuum and the other containing flush fluid.

A primary objective of the present invention is to provide an apparatus and method of use of such apparatus that provides advantages not taught by the prior art.

Another objective is to provide such an invention capable of moving fluids between containers and an automotive radiator for cleaning and refilling with only an initial vacuum drawn on one or more containers.

A further objective is to provide such an invention capable of quick and easy modification for various applications.

A still further objective is to provide such an invention capable of valving a fluid such as a cleaning or treatment agent, directly from a bottle into a nozzle fitted to an automobile radiator.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
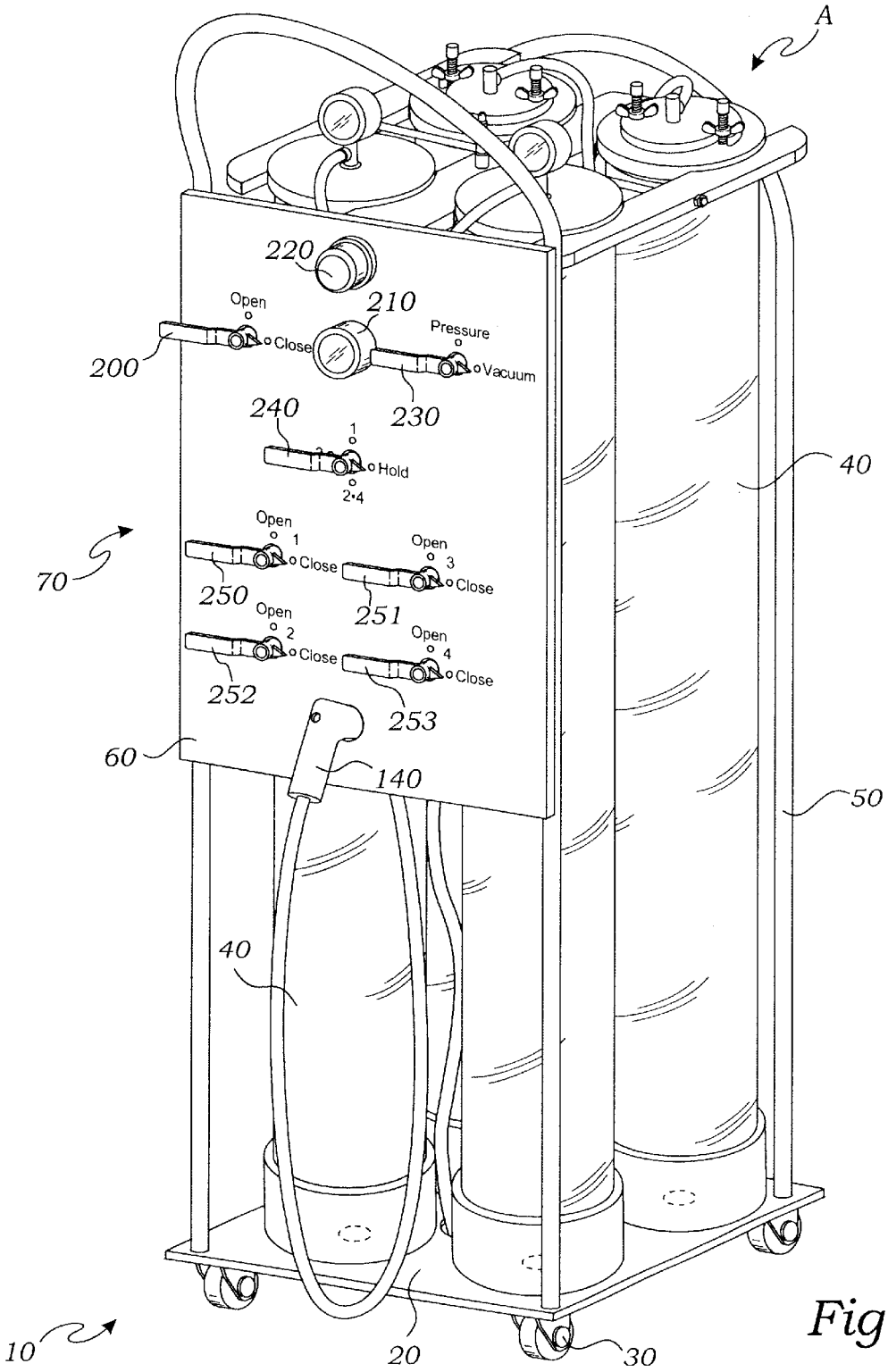
FIG. 1 is a perspective view of a first preferred embodiment of the invention.
Figure 2:
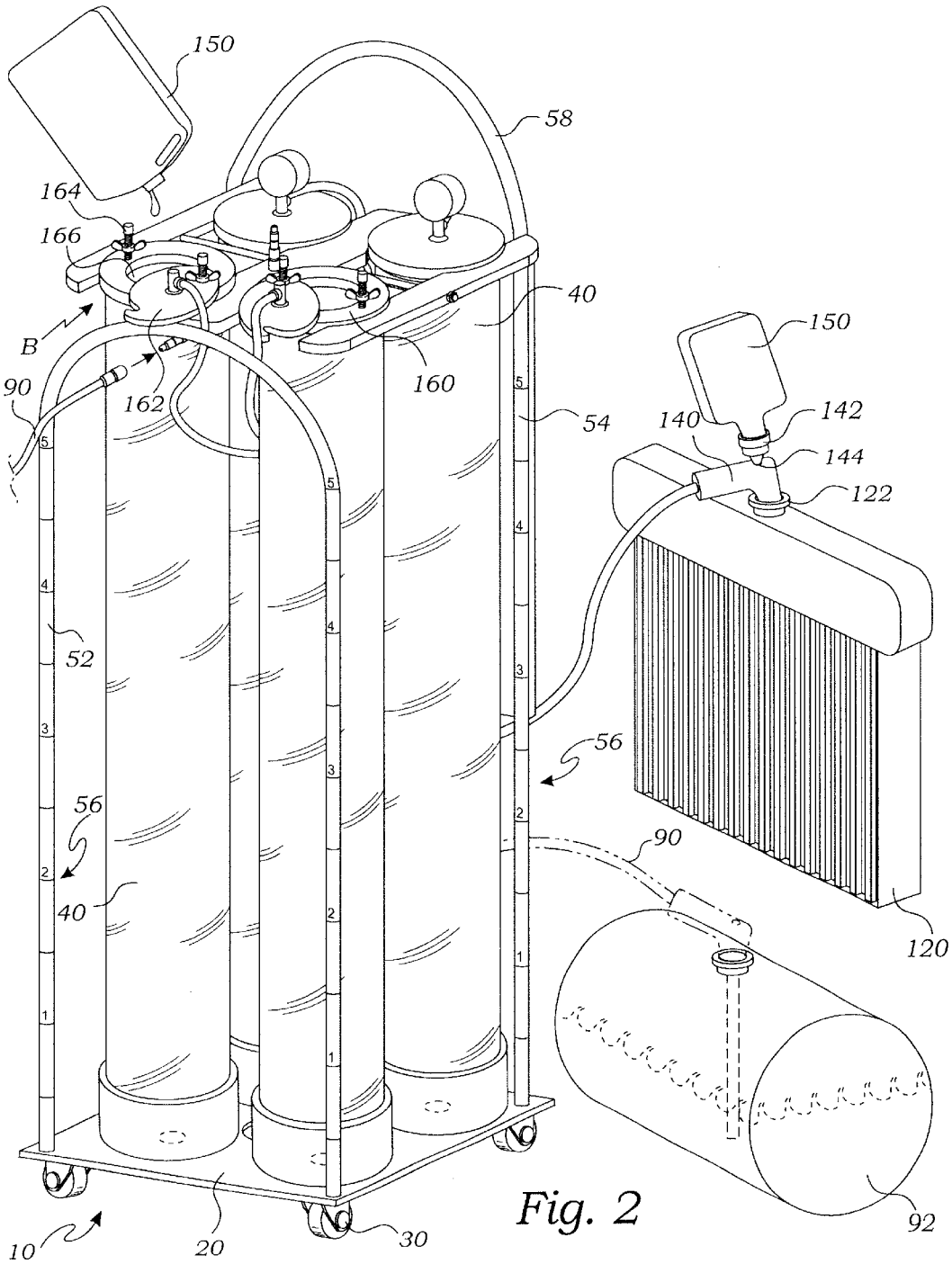
FIG. 2 is a similar view thereof showing its operation.

The present invention preferably uses an apparatus comprising a wheeled cart 10 made up of a platform 20 supported on a set of wheels 30 so that the cart 10 may be manually pushed from place to place. The platform 20 comprises a rigid plate having a flat upwardly facing surface. Mounted on the platform 20 is a plurality of containers 40 placed in adjacent upright attitudes as shown in FIGS. 1, 2, 6, 8 and 10. The containers 40 are preferably constructed as cylinders with capped ends and made of glass, polycarbonate plastic, fiberglass, or any other structural transparent substance so that one may view the contents of a contained fluid, as to color, level, quality and any other attributes. A support framework 50 is engaged with the platform 20 and supports an operator's panel 60 which provides operator's controls 70 as well shown in FIGS. 1, 6, 8, and 10. Preferably, the support framework 50 comprises a pair of U-shaped rods 52 and 54, with the rod 54 extended for providing a handle 58. The support framework 50 provides level indicating indicia 56 as shown in FIG. 2. This is clearly shown in FIGS. 1, 2, 6, 8 and 10. The controls 70 are associated with a suction developing means 80 such as an ejector which is preferably a common, well known, device which uses the flow of a compressed gas to generate a minor negative suction through the venturi effect, a pressure developing means, which may be any source of gas pressure such as a compressor (not shown) and used in conjunction with a compressed gas storage tank 92 (FIG. 2) and delivery hose 90 (FIG. 3), conduit switching means 200 such as manual or automatic valves, and conduit manifolding means 110 such as the manifolds shown in FIGS. 3, 7, 9 and 11. It is noted, that the suction developing means 80 is not necessary in carrying out the present invention methods defined herein and in the attached claims. In common use, in automotive shops and garages, a compressor is used for generating compressed air which is stored in a tank. The ejector may be used with such a supply of compressed air to generate an initial vacuum in one or more of the containers 40 whereupon the apparatus may be then moved to any remote location for completing its objectives of fluid exchange, and this without any further electrical or gas hookup. This is an important advantage in that the apparatus may be wheeled to a convenient location for beneficial use, for instance, in a parking lot. The prior art does not teach such application and advantage. In the present invention there is no need to raise a vehicle above floor level, no need to use garage space, and it is environmentally safe, no need to have a constant source of air pressure available or applied, or to take the time to generate vacuum. Clearly, all of these advantages provide significant saving of time, labor and energy.

Figure 3:
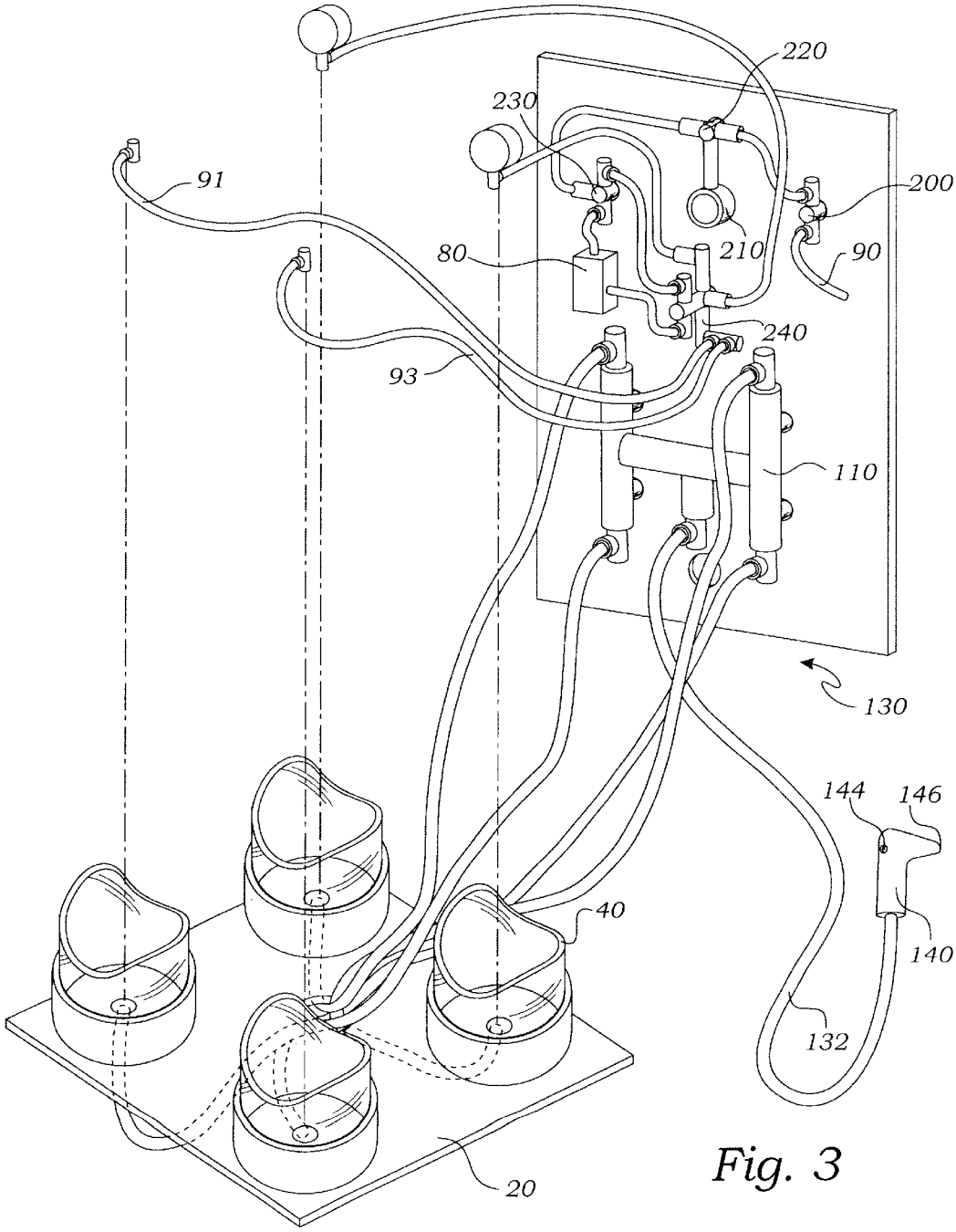
FIG. 3 is a similar view thereof showing the back of a control panel with cable interconnections of the invention.

The controls 70 are enabled for acting together to apply vacuum and pressure exertion on fluids for driving the fluids between any one of the containers 40 and an automotive radiator 120 through a system of conduits 130. The arrangement of these controls 70 and conduits 130 may be made in accordance with any design for application of fluids and is able to provide movement of the fluids driven by gas pressure or by suction. For instance, a suction may be applied to the radiator 120 shown in FIG. 2, to produce a negative pressure within this radiator 120. By stoppering the radiator it then is possible to maintain the negative pressure and to use it to draw liquids from the containers 40 into the radiator 120. Any number of fluids may thus be drawn and in any order. In the same manner it is possible to draw liquid fluids from the radiator 120 into any one of the containers. Selection is made via the control panel 70. In the preferred embodiment, as shown in FIGS. 1 and 3, air pressure is applied through conduit 90 to control 200, an open-close valve. Pressure gauge 210 reads the pressure level as supplied. Regulator 220 adjusts the pressure as desired. Pressure-vacuum valve 230, a three or four way valve, selects the mode desired, i.e., whether pressure or vacuum. Such is directed through valve 240 to selected containers 40. When the operating effect or mode selected is "pressure," it is directed to the top of the appropriate container 40, as shown, for example by conduits 91 and 93 in FIG. 3 and fluids are forced then from the bottom of the appropriate selected container 40 into manifold 110 and selected by valves 250, 251, 252, and 253 to conduit 132 for delivery to the radiator 120. When mode is "vacuum," it is applied for drawing fluid from the radiator 120 into one of the containers 40 and after all of the fluid is drawn therefrom, a partial vacuum condition remains in the radiator 120. Therefore, in this mode, liquid is drawn from the radiator 120, through nozzle 140 and delivery tube 132 to manifold 110 and thus into a selected container 40. Suction is applied from selection valve 240 through, for instance, conduits 91 or 93.

Figure 4:
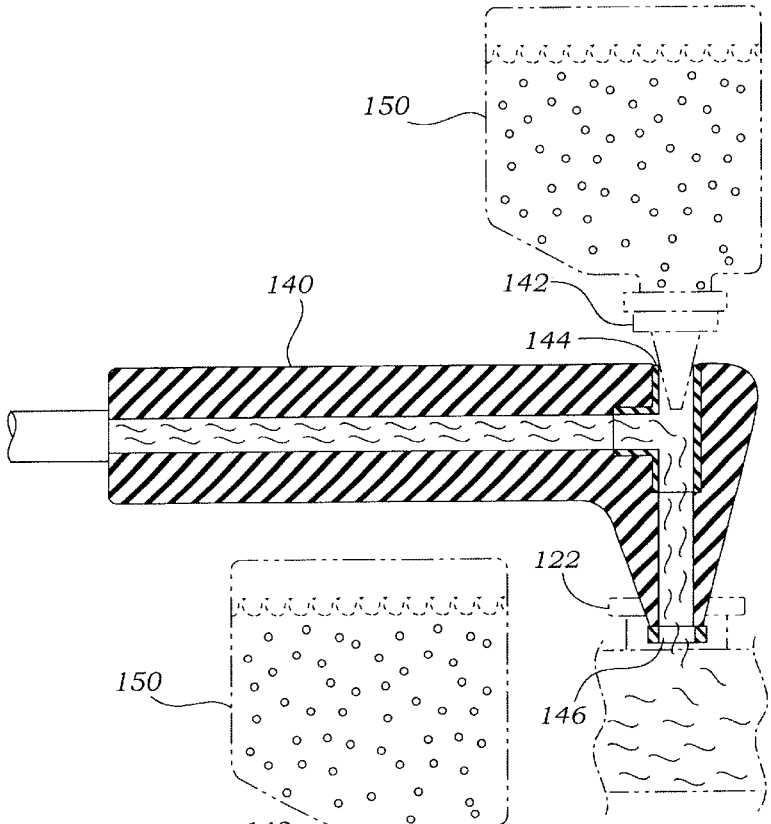
FIGS. 4 and 5 are side elevational sectional views thereof showing operation of a nozzle of the invention.
Figure 5:
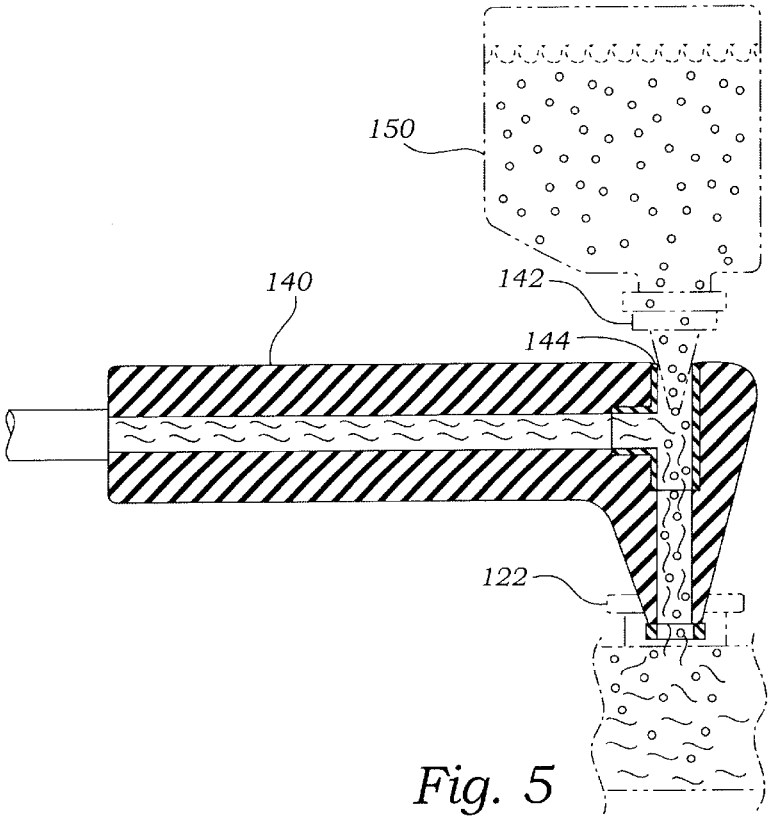

Preferably, conduit 132 terminates with the nozzle 140 adapted by its shape and elastic material properties for sealing a radiator fill pipe nipple 122 while exchanging the fluids therewith. This is clearly shown in FIG. 2. The ability to seal the pipe nipple 122 is important so that suction may be held within the radiator 120 during fluid transfer as discussed above. The nozzle 140 may have incorporated within it, or removably receive an on-off valve 142 for admitting a fluid into the nozzle 140 through a nozzle aperture 144 situated above the nozzle's discharge point 146. A fluid containing bottle 150 delivers chemicals such as cleaning and conditioning agents or other fluids to radiator 120. The nozzle aperture 144 is adapted by its shape for engaging the valve 142 which is necessary to prevent loss of suction when the fluid bottle 150 is placed in an inverted position for draining the fluid bottle 150 through the valve 142 into the nozzle 140 and thus to the radiator fill pipe nipple 122 and the radiator itself 120. This is best seen in FIGS. 4 and 5. It should be recognized that the present system works by reverse suction technique. The radiator is reduced to a low pressure by direct suction. Thereafter, the radiator provides suction for drawing fluids from the containers 40 and bottle 150, into the radiator. Therefore, nozzle 140 and valve 142 play the important role of sealing the system while the bottle 150 is placed into the nozzle. This is possible only because the nozzle is made of a soft rubber with the property of forming a seal between the pipe nipple 122 and the valve 142.

The containers 40 are preferably closed by a threaded connection or with tie-downs 164 on a disk-shaped metal cap 160. The cap 160 provides a fastened cover 162 engaged with the cap 160 by the tie-downs 164. The cover 162 is enabled, by this mounting for sliding movement between a closed position "A" for sealing the cap 160 as shown in FIG. 1, and an open position "B" for exposing a cap aperture 166 for receiving fluids into the container 40 as shown in FIG. 2.

Clearly, the apparatus may include any number of the containers 40 depending upon the application. In a 4 container configuration shown in FIGS. 1–3 and 10 the apparatus has the ability to receive spent coolant in one container 40 so as to empty the radiator 120, discharge fresh water from a second container 40 along with a cleaning fluid from a bottle into the radiator 120 to flush the radiator, receive the spent flush in yet another of the containers 40 and, finally, discharge new coolant from a fourth of the containers 40 into the radiator 120. Many other applications exist for the use of the invention in automotive maintenance. For instance, plural containers may be applied for large capacity cooling systems as one might find in large diesel engines for earth movers and such; and here the ability to bring the vacuum and pressure to the machine becomes an important advantage.

Figure 6:
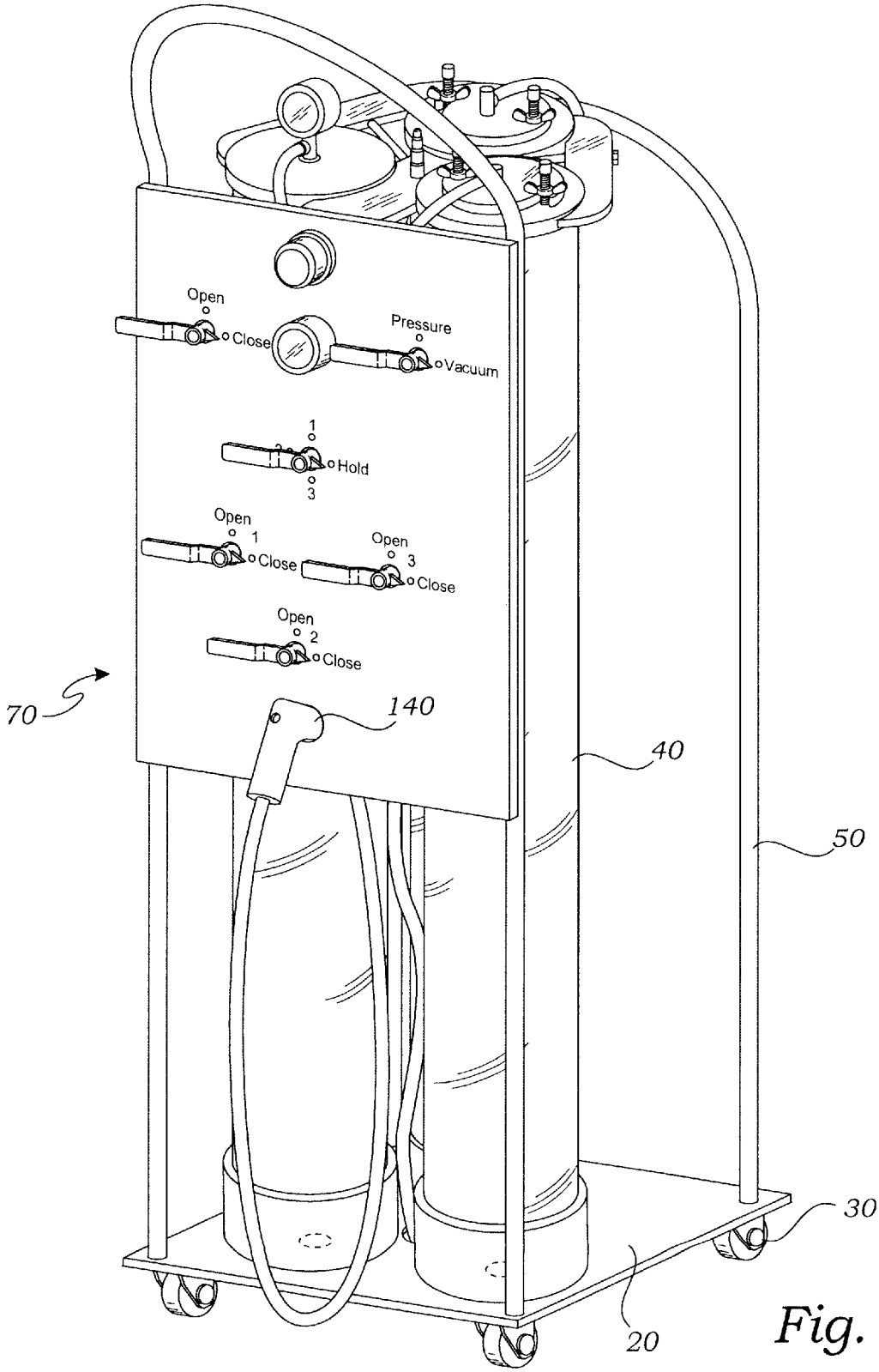
FIG. 6 is a perspective view of a second preferred embodiment of the invention.
Figure 7:
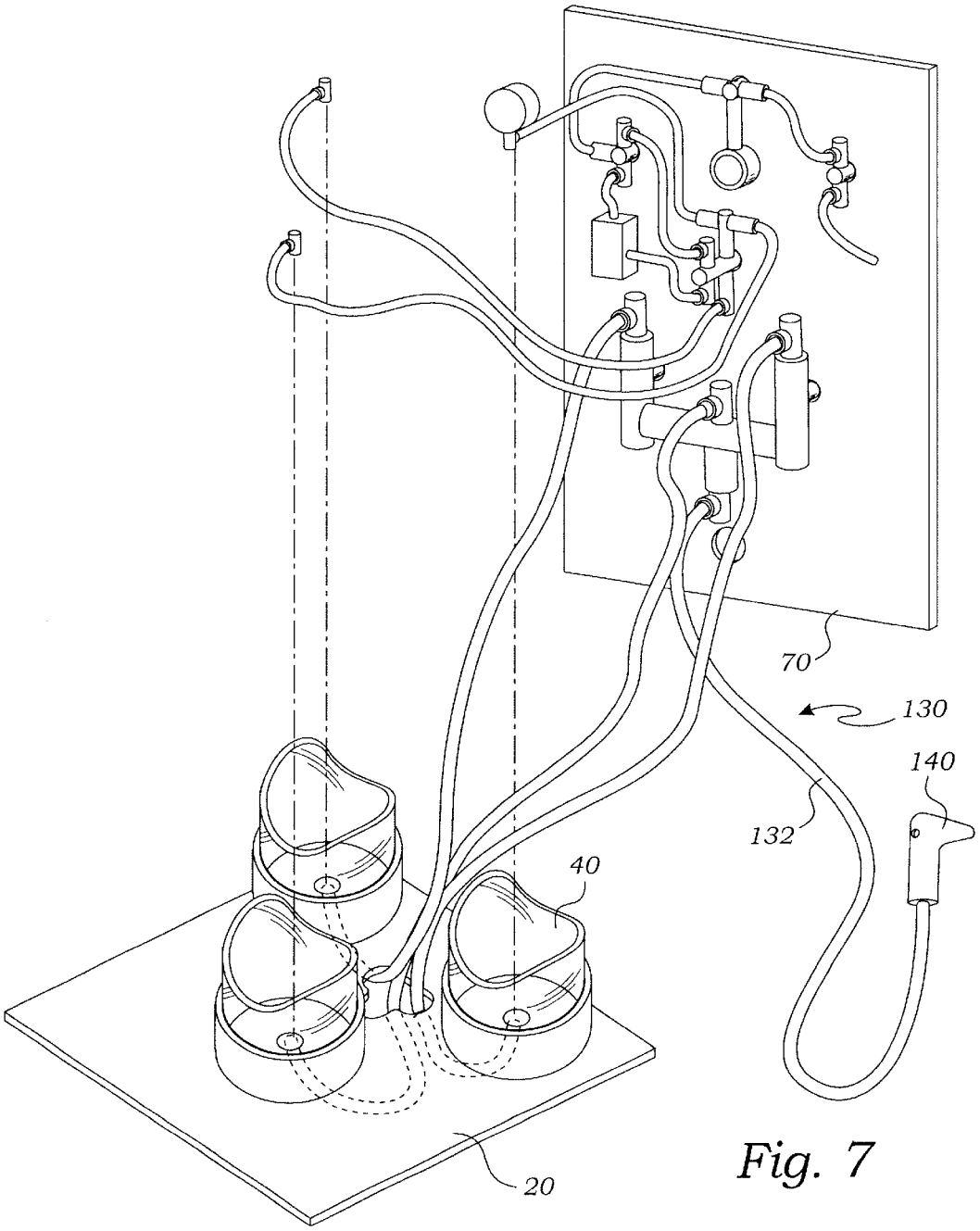
FIG. 7 shows the cable interconnections thereof.

In the configuration shown in FIGS. 6 and 7, the apparatus uses 3 containers 40 and is able thereby to receive spent coolant in one container 40, flush with fresh water from a second container 40 and with cleaner from a bottle 150, and install fresh coolant from a third of the containers 40.

Figure 8:
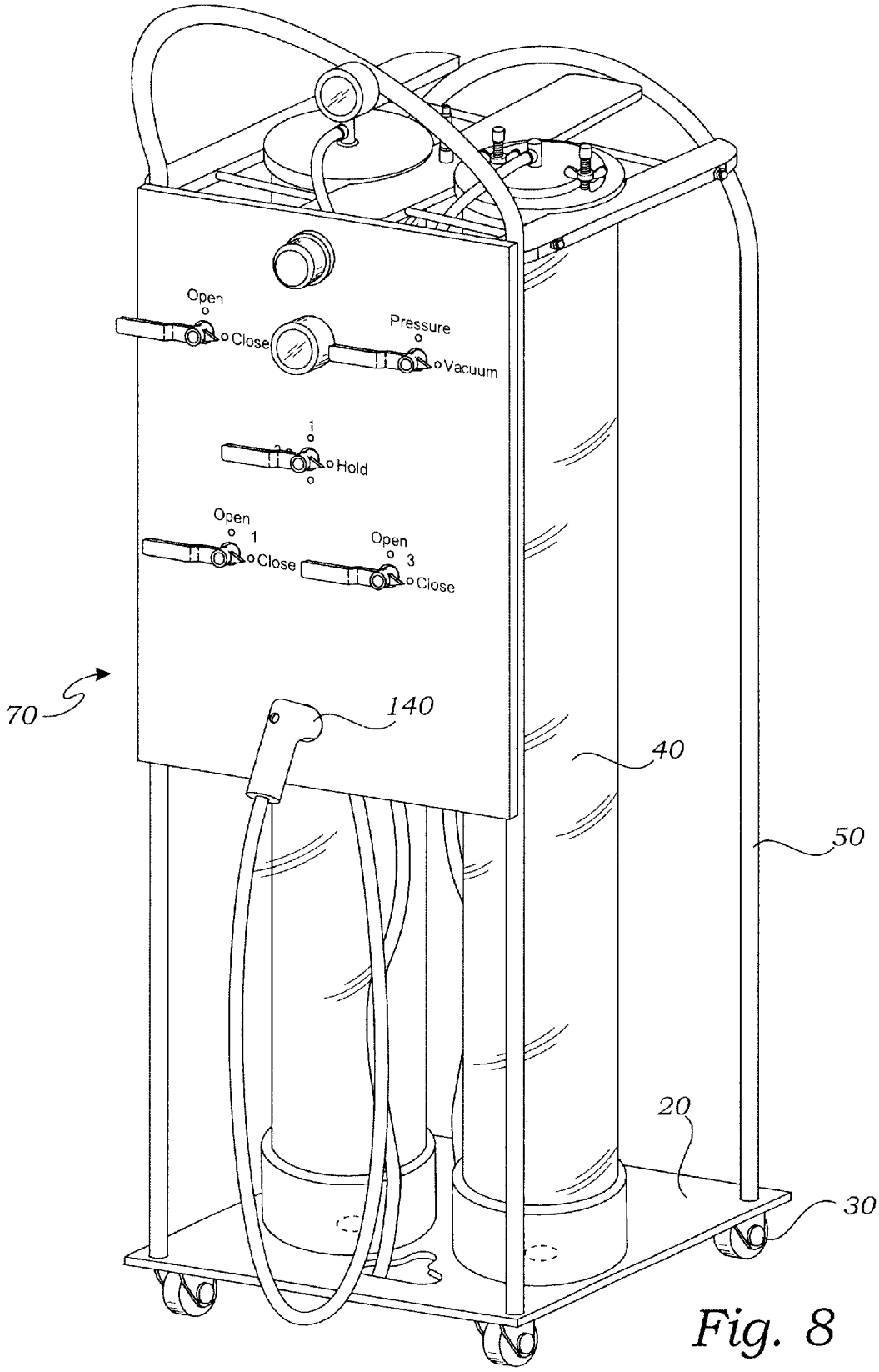
FIG. 8 is a perspective view of a third preferred embodiment of the invention.
Figure 9:
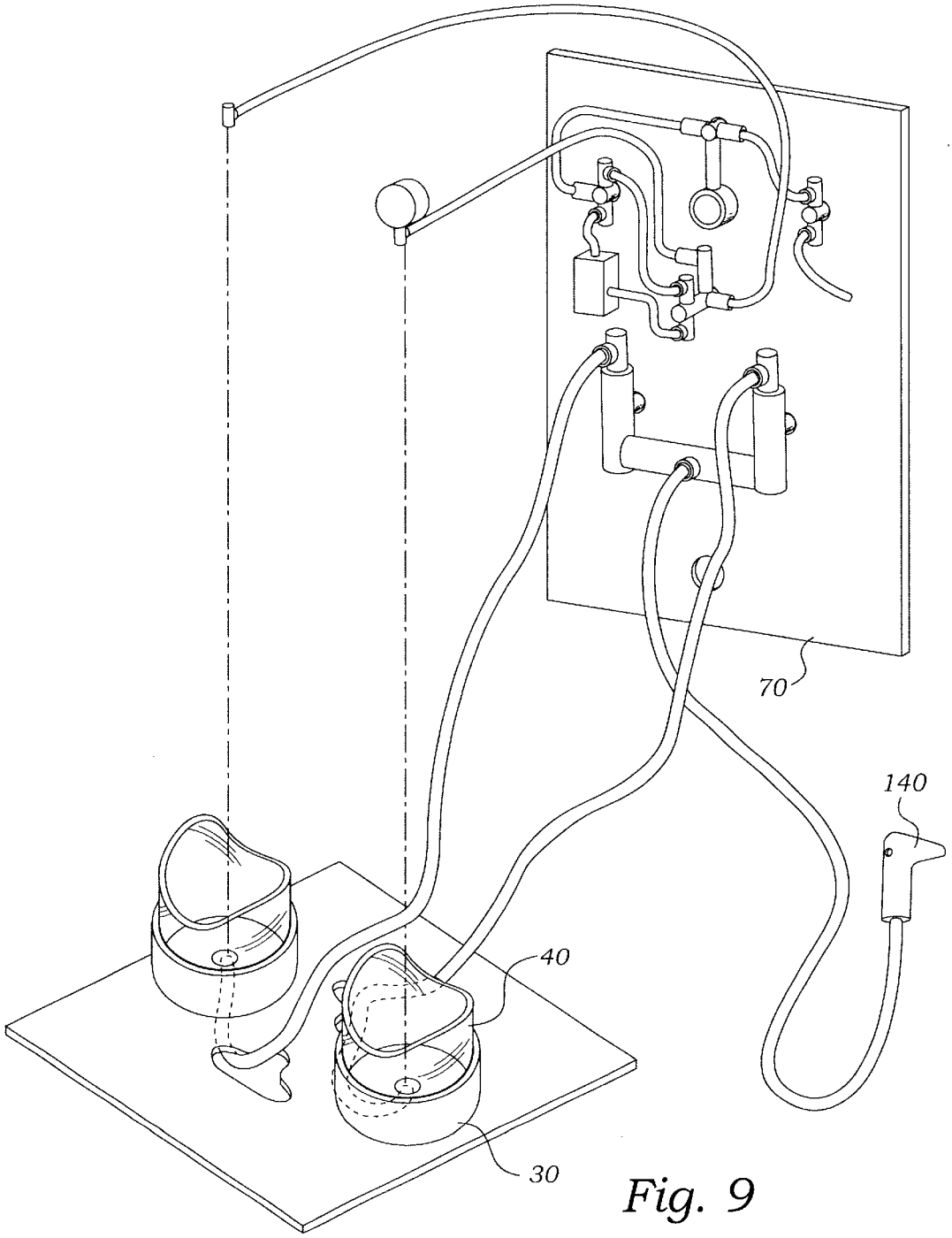
FIG. 9 shows the cable interconnections thereof.
Figure 10:
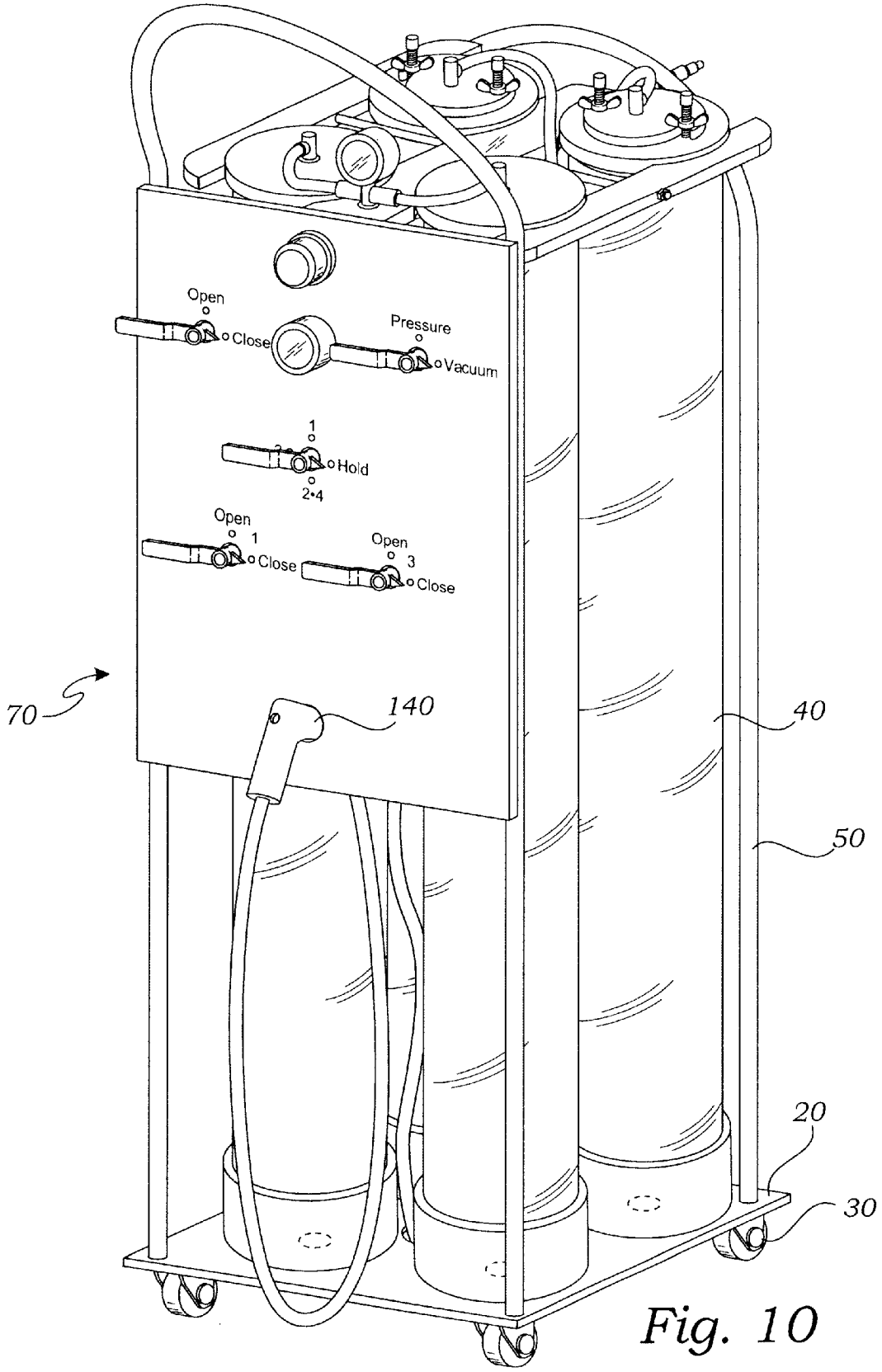
FIG. 10 shows a modification of the first embodiment shown in FIG. 1.
Figure 11:
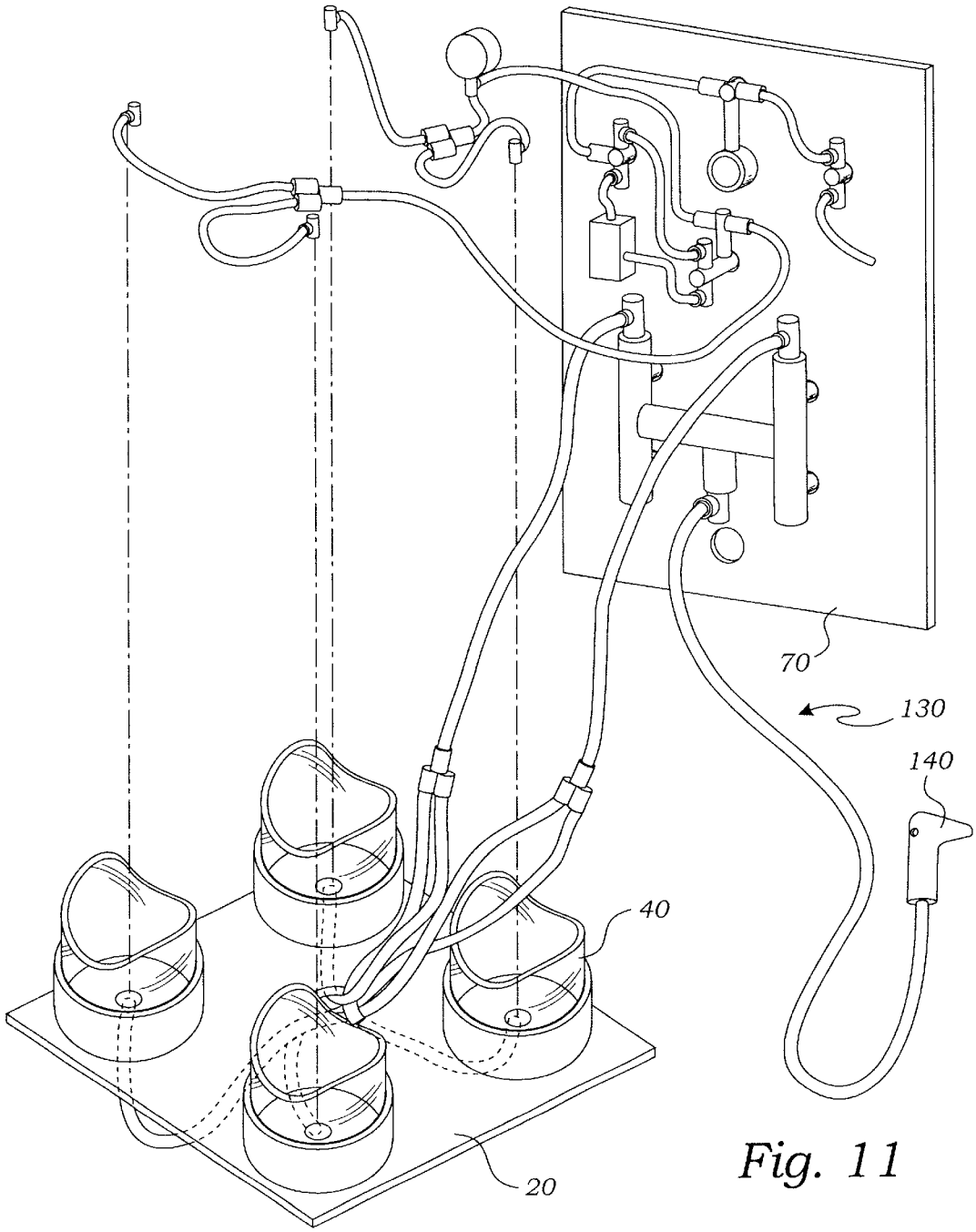
FIG. 11 shows the cable interconnections thereof.

In the configuration shown in FIGS. 8 and 9, the apparatus uses 2 containers 40 and is able thereby to receive spent coolant in one container 40, and install new coolant from a second of the containers 40. This shortcut approach is most applicable for new automobiles where the coolant system is not very dirty.

Obviously, the number of applications, fluids, containers and the method steps for providing radiator and other types of automotive and non-automotive maintenance is not limited to the few examples shown here, but is open to a vast number of potential situations and possibilities, the preferred methods described below.

A first preferred embodiment of the present invention method replaces the radiator fluid in the automotive radiator 120 and uses two containers 40 as shown in FIGS. 6 and 8, each of the containers providing a means for sealing against gas leaks, as described above. The means for fluid conduction 132 (flexible hose), is integral with the nozzle 140 which is adapted by its shape and material for sealing the radiator fill pipe nipple 122. The method includes filling a first one of the containers with a fresh radiator fluid; drawing a vacuum on a second one of the containers 40 as is fully described above; establishing suction, using the means for fluid conduction 132, between the automotive radiator 120 which contains a spent radiator fluid, and the second one of the containers; drawing the spent radiator fluid into the second one of the containers using only suction from the second one of the containers, thereby leaving the automotive radiator 120 under partial vacuum; establishing suction, using the means for fluid conduction 132, between the radiator 120 and the first one of the containers; and drawing the fresh radiator fluid, from the first one of the containers, into the radiator 120 using only suction from the radiator 120. Clearly, this entire process may be performed in the field using only the partial vacuum carried into the field by the initial suction drawn on the second one of the containers 40. This method uses the control valve 240 joined for fluid conduction between each of the containers and the means for fluid conduction 132; and selecting first, the second ones of the containers 40 using the control valve 240 to enable suction on the automotive radiator 120, and thereafter selecting second, the first one of the containers 40 using the control valve 240 to enable suction on the first one of the containers 40.

Figure 12:
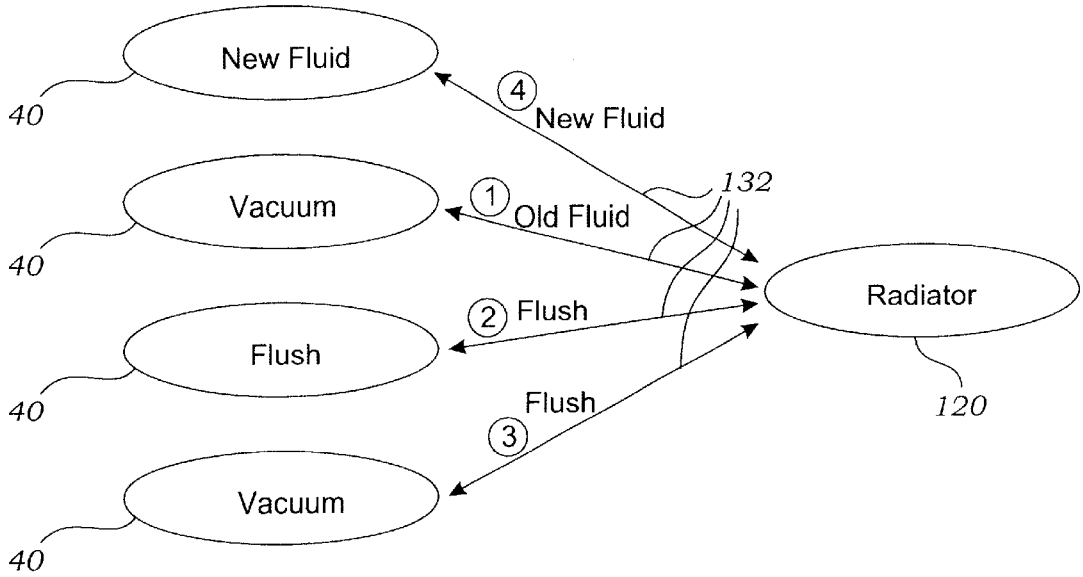
FIG. 12 is a graphical representation of the method of the present invention.

In a further preferred embodiment of the present invention method, as shown in FIG. 12, four containers 40 are used. Again, a first one of the containers 40 is filled with a fresh or new radiator fluid. A third one of the containers is filled with a radiator flush or cleaning fluid of any well known type. A partial vacuum is drawn on a second and a fourth ones of the containers 40 from any source of vacuum, such as described above. Suction is provided, using the means for fluid conduction 132, between the automotive radiator 120 which contains the spent radiator fluid, and the second one of the containers 40; drawing the spent (old) radiator fluid into the second one of the containers, through the fluid conduction means 132, using only suction from the second one of the containers and thereby leaving the automotive radiator 120 under a partial vacuum. Next, suction is established, using the means for fluid conduction 132, between the automotive radiator 120 and the third one of the containers for drawing the radiator flush into the radiator 120, using only suction from the radiator 120 and, thereby, leaving the third one of the containers at atmospheric pressure, i.e., as flush is drawn out of the third one of the containers 40, air is drawn in. Suction is next established, using the means for fluid conduction 132, between the automotive radiator 120, now containing the radiator flush, and the fourth one of the containers 40, thereby drawing the radiator flush from the automotive radiator 120 into the fourth one of the containers 40, through the fluid conduction means 132, using only suction from the fourth one of the containers and, thereby, leaving the automotive radiator 120 under a partial vacuum. Finally, suction is established, using the means for fluid conduction 132, between the automotive radiator 120, and the first one of the containers for drawing the fresh (new) radiator fluid into the automotive radiator 120, using only suction from the radiator 120 and thereby leaving the automotive radiator 120 clean and filled with fresh radiator fluid.

The control valve 240 is joined for fluid conduction between each of the four containers and the means for fluid conduction 132. It is able to make selection as to which of the four containers is interconnected, at any one time, with the means for fluid conduction 132. In the above method, first, the second one of the containers 40 is selected to enable suction on the automotive radiator 120, and thereafter the third one of the containers 40 is selected to enable suction on the third one of the containers 40. Next, the fourth one of the containers 40 is selected, to enable suction on the radiator 120, and finally, the first one of the containers 40 is selected to enable suction on the first one of the containers 40.

In order to dispense with spent radiator fluid and flush, the invention method further may comprise the steps of: pressurizing the second one of the containers from a garage compressor, or example; establishing connection with the means for fluid conduction 132 between, in turn, the second one of the containers 40 and then the first one of the containers 40, and a waste repository such as a waste container, etc., to enable dispensing of the spent radiator fluid and the used flush.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method of replacing radiator fluid in an automotive radiator, the method comprising the steps of: providing at least two containers, each of the containers providing a means for sealing against gas leaks from and into the container, a means for fluid conduction, the fluid conduction means integral with a nozzle adapted for sealing a radiator fill pipe nipple; filling a first one of the containers with a fresh radiator fluid; drawing a vacuum on a second one of the containers; establishing suction, using the means for fluid conduction, between an automotive radiator containing a spent radiator fluid, and the second one of the containers; drawing the spent radiator fluid into the second one of the containers using only suction from the second one of the containers, thereby leaving the automotive radiator under vacuum; establishing suction, using the means for fluid conduction, between the radiator and the first one of the containers; and drawing the fresh radiator fluid, from the first one of the containers, into the radiator using only suction from the radiator.

2. The method of claim 1 further comprising the steps of: providing a control valve joined for fluid conduction between each of the at least two containers and the means for fluid conduction; and selecting first, the second one of the containers using the control valve to enable suction on the automotive radiator, and thereafter selecting second, the first one of the containers using the control valve to enable suction on the first one of the containers.

3. The method of claim 1 further comprising the steps of: pressurizing the second one of the containers and establishing connection with the means for fluid conduction between the second one of the containers and a waste repository to enable dispensing of the spent radiator fluid.

4. A method of replacing radiator fluid in an automotive radiator, the method comprising the steps of: providing at least four containers, each of the containers providing a means for sealing against gas leaks from and into the container, a means for fluid conduction, the fluid conduction means integral with a nozzle adapted for sealing a radiator fill pipe nipple; filling a first one of the containers with a fresh radiator fluid; filling a third one of the containers with a radiator flush; drawing a high vacuum on a second and a fourth one of the containers; establishing suction, using the means for fluid conduction, between an automotive radiator containing a spent radiator fluid, and the second one of the containers; drawing the spent radiator fluid into the second one of the containers, through the fluid conduction means, using only suction from the second one of the containers, thereby leaving the automotive radiator under a partial vacuum; establishing suction, using the means for fluid conduction, between the automotive radiator and the third one of the containers; drawing the radiator flush into the radiator, through the fluid conduction means, using only suction from the radiator, thereby leaving the third one of the containers at atmospheric pressure; establishing suction, using the means for fluid conduction, between the automotive radiator containing the radiator flush, and the fourth one of the containers; drawing the radiator flush into the fourth one of the containers, through the fluid conduction means, using only suction from the fourth one of the containers, thereby leaving the automotive radiator under a partial vacuum; establishing suction, using the means for fluid conduction, between an automotive radiator, and the first one of the containers; drawing the fresh radiator fluid into the automotive radiator, through the fluid conduction means, using only suction from the radiator, thereby leaving the automotive radiator clean and filled with fresh radiator fluid.

5. The method of claim 4 further comprising the steps of: providing a control valve joined for fluid conduction between each of the at least four containers and the means for fluid conduction; and selecting first, the second one of the containers using the control valve to enable suction on the automotive radiator, and thereafter selecting second, the third one of the containers using the control valve to enable suction on the third one of the containers; and thereafter selecting third, the fourth one of the containers using the control valve to enable suction on the radiator; and thereafter selecting fourth, the first one of the containers using the control valve to enable suction on the first one of the containers.

6. The method of claim 4 further comprising the steps of: pressurizing the second one of the containers; establishing connection with the means for fluid conduction between the second one of the containers and a waste repository to enable dispensing of the spent radiator fluid; and establishing connection with the means for fluid conduction between the fourth one of the containers and a further waste repository to enable dispensing of the used flush.

* * * * *